United States Patent [19]

Griz

[11] Patent Number: 4,539,970

[45] Date of Patent: Sep. 10, 1985

[54] BOWSTRING-HELD ARCHERY DEVICE

[76] Inventor: Peter R. Griz, 2655 Baldwin, Oxford, Mich. 48051

[21] Appl. No.: 517,332

[22] Filed: Jul. 26, 1983

[51] Int. Cl.[3] ..... F41B 5/00

[52] U.S. Cl. ..... 124/90

[58] Field of Search ..... 124/90, 91, 23 R, 24 R, 124/35 A, 1

[56] References Cited

U.S. PATENT DOCUMENTS 1,885,962 11/1932 Swenson et al. ..... 124/90

3,291,111 12/1966 Smith ..... 124/23 R

*Primary Examiner*—Richard J. Apley

*Assistant Examiner*—William R. Browne

*Attorney, Agent, or Firm*—William L. Fisher

[57] ABSTRACT

A bowstring-held archery device which serves as an anchor point for an archer's pulling hand, the device having a body and a tail projecting from the body, the body having an arrangement for holding the device on a bowstring in fixed relationship thereto, the tail having sufficient length to project into the corner of the archer's mouth, whereby the bowstring-held archery device enables the archer to consistently duplicate the anchor point, and the device allowing the archer to see the bowstring during aiming without interfering with sighting of a target.

4 Claims, 6 Drawing Figures

FIG. 2
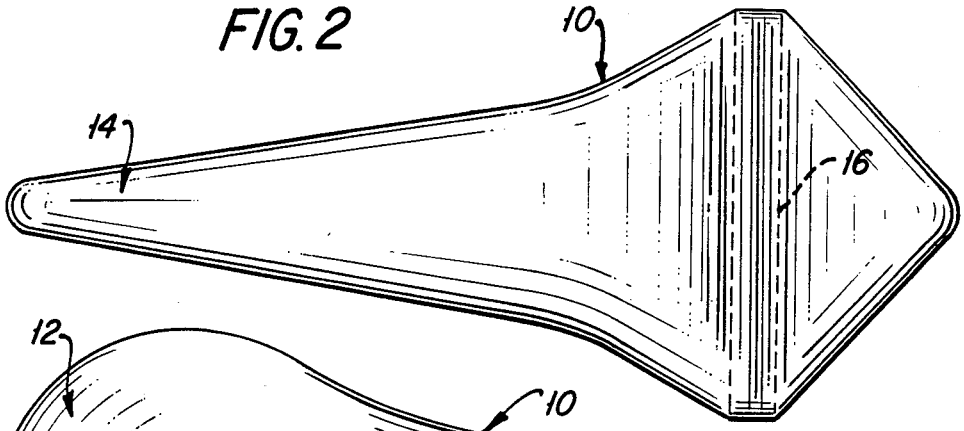
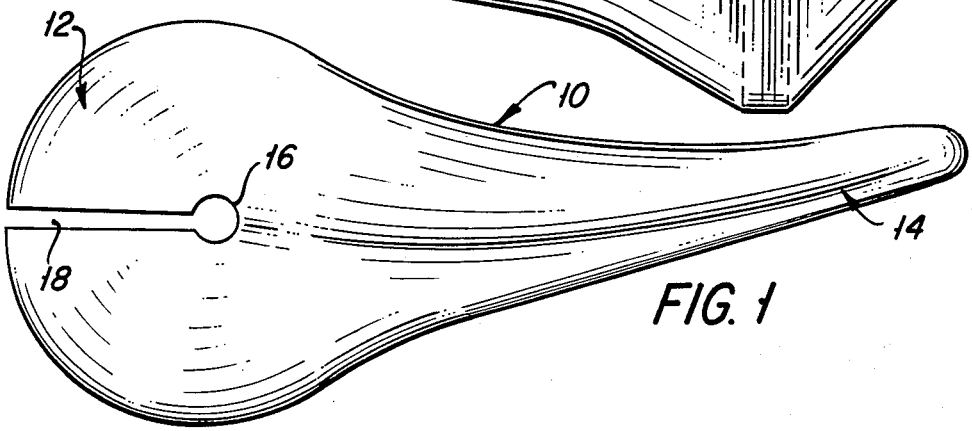
FIG. 1
FIG. 3
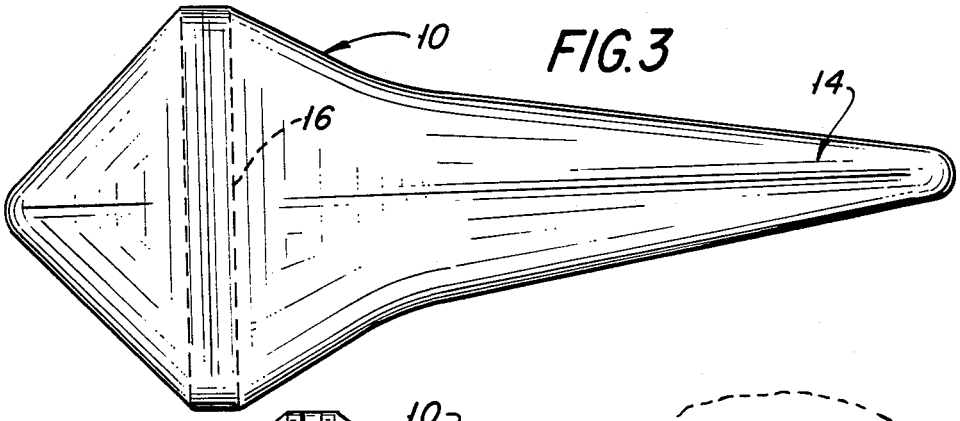
FIG. 4
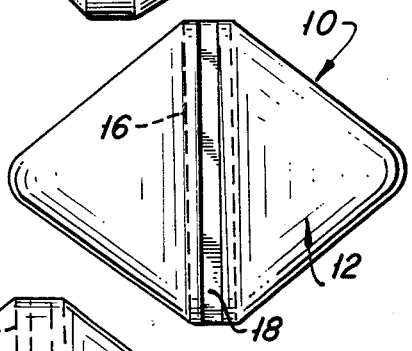
FIG. 5
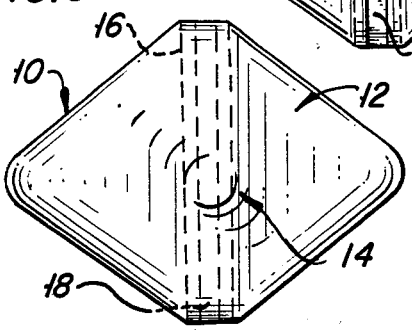
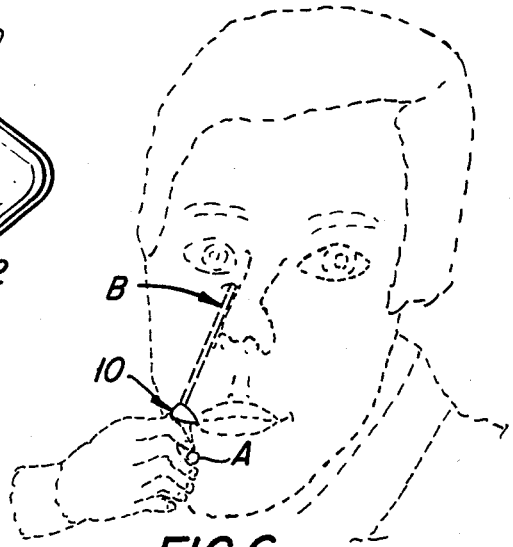
FIG. 6

BOWSTRING-HELD ARCHERY DEVICE

My invention relates to archery and has for its principal object the provision of a novel bowstring-held archery device which serves, during shooting of arrows, as a consistently duplicatable rear anchor point for the archer's pulling hand.

A rear anchor anchor point for the pulling hand is essential to an archer but heretofore he has had to guess or approximate where he is at on his face or cheek with his fingers. Bowstring-held "kissing buttons" which are supposed to lightly touch or "kiss" the check have been proposed but these do not really touch or "kiss" the cheek or, if they do, the do so too lightly. In any event, they involve as much guesswork or approximation as without them.

The foregoing object of my invention and the advantages thereof will become apparent during the course of the following description, taken in conjunction with the accompanying drawings, in which:

FIGS. 1-5 are top plan, outside elevational, inside elevational, front and rear elevational views, respectively of a novel bowstring-held archery device embodying my invention;

FIG. 6 is a perspective view showing said bowstring-held archery device in use during shooting of an arrow.

Referring to the drawings in greater detail, 10 generally designates said bowstring-held archery device which I herewith designate "Griz's bowpipe" which term I wish to have used whenever reference thereto is made. "Griz's Bowpipe" bowstring-held archery device comprises a body 12 and a tail 14 projecting from the body 12. The body is provided with a central aperture 16 and slot 18 which opens the aperture 16 to the exterior of the body 12; both said aperture 16 and said slot 18 extend through said body 12 substantially vertically from top to bottom thereof.

The diameter of the aperture 16 is substantially equal to that of the bowstring on which "Griz's Bowpipe" bowstring-held archery device is held. The tail 14 must project from the body 12 sufficiently to span the archer's fingers so that same can reach laterally from the bowstring and project into the corner of the archer's mouth. To insert "Griz's Bowpipe" bowstring-held archery device on an archer's bow, the slot 18 is expanded slightly in width to receive and pass the bowstring therethrough. The press fit and close tolerance of "Griz's bowpipe" bowstring-held archery device is sufficient to hold same fast on the bowstring. To be sure that "Griz's Bowpipe" bowstring-held archery device will remain fast in its proper position on the bowstring, a suitable liquid adhesive (for example, colorless nail polish) should be applied to "Griz's Bowpipe" bowstring-held archery device so that it fills the aperture 16 and saturates the bowstring therewithin. FIG. 6 shows "Griz's Bowpipe" bowstring-held archery device 10 held on a bowstring "B" above an arrow "A" so that the tail 14 projects laterally from the bowstring "B" into the corner of the archer's mouth. In reference to the archer, the projection of the tail 14 is toward his inside and the inside surface of said tail which bears against the corner of the archer's mouth is concavely curved in plan view, as shown in FIG. 1. For a left handed archer, FIGS. 1 and 6 would be mirror images of those shown (which are for a right-handed archer); that is, "Griz's Bowpipe" bowstring-held archery device would be held upside down from that shown in FIGS. 1 and 6 in which event the tail 14 would then project into the left-hand corner of the archer's mouth; the concavely cured inside surface of the tail 14 would still be the inside surface of the device 10. Vertically, "Griz's Bowpipe" bowstring-held archery device is positioned on the bowstring "B" above the arrow "A" approximately a finger's width; the index finger, in the instance; the conventional "nocking" point (an annular ring held fast on the bowstring "B") for the rear tip of the arrow is within said finger's width, i.e. it is disposed above the arrow (but bearing thereagainst) and below "Griz's Bowpipe" bowstring-held archery device (and spaced therefrom).

In use of "Griz's Bowpipe" bowstring-held archery device 10, once it is properly positioned on the bowstring "B" and made fast thereto as shown and described, the tail 14 is drawn into the corner of the archer's mouth so that said device 10 serves, during shooting of arrows, as a consistently duplicatable rear anchor point for the archer's pulling hand. "Griz's Bowpipe" bowstring-held archery device enables the archer to locate his pulling hand at the exact same location for each and every shot and eliminates all guesswork and approximation. Consistently duplicatable positioning of the archer's pulling hand and hence of the rear arrow tip means that said rear anchor point can be relied upon as a sight for aiming as the bowstring can be seen during aiming without interfering with sighting of a target. Likewise, same means that said anchor point can be relied upon as a trustworthy predetermined pull on the bowstring. Only the arrow trajectory need be adjusted (by raising or lowering the front tip of the arrow) for any given target to enable the arrow to travel the required distance thereto. Most pulls in arrow shooting are hard and, with a compound bow include a short pause or static hold, so that an anchor point for the pulling hand is essential; a consitently duplicatable one is an archer's "dream" enabling him to achieve his greatest possible accuracy.

It will thus be seen that there has been provided by my invention a bowstring-held archery device in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. A bowstring-held archery device which serves as an anchor point for an archer's pulling hand, said device being elongated and having a body and a tail projecting from said body, said body having means for independently and totally supporting the device on a bowstring in fixed relationship thereto, the tail having sufficient length to project into the corner of the archer's mouth, whereby said bowstring-held archery device enables the archer to consistently duplicate said anchor point, and said device allowing the archer to see the bowstring during aiming without interfering with sighting of a target.

2. A bowstring-held archery device as claimed in claim 1, said body having an aperture therein and a slot which opens the aperture to the exterior of said body, said aperture having a diameter substantially equal to that of the bowstring on which said device is held, the width of said slot being less than the diameter of said aperture, both said aperture and slot extending through said body substantially vertically from top to bottom thereof.

3. "Griz's Bowpipe" bowstring-held archery device as claimed in claim 2, said tail, in plan view, being provided with a concavely curved inside surface.

4. A bowstring-held archery device which serves as an anchor point for an archer's pulling hand, said device having a body and a tail projecting from said body, said body having a central aperture therein and a slot which opens the aperture to the exterior of said body, said aperture having a diameter substantially equal to that of the bowstring on which said device is held, the width of said slot being less than the diameter of said aperture, both said aperture and slot extending through said body substantially vertically from top to bottom thereof, said tail projecting from the body sufficiently to reach into the corner of the archer's mouth, whereby said bowstring-held archery device enables said archer to consistently duplicate said anchor point, and said device allowing the archer to see the bowstring during aiming without interfering with sighting of a target.

* * * * *